US005768704A

United States Patent [19]

Greenhalgh

[11] Patent Number: 5,768,704

[45] Date of Patent: Jun. 23, 1998

[54] CUSHION FOR ATHLETIC GLOVE

[76] Inventor: Jeffrey L. Greenhalgh, 3315 Korina La., Tampa, Fla. 33618

[21] Appl. No.: 839,647

[22] Filed: Apr. 15, 1997

[51] Int. Cl.[6] ..... A41D 13/00

[52] U.S. Cl. ..... 2/16; 2/19; 2/20

[58] Field of Search ..... 2/16, 19, 20, 158, 2/159, 160, 161.1, 161.5, 163

[56] References Cited

U.S. PATENT DOCUMENTS

| | | | |
|---|---|---|---|
| 1,465,223 | 8/1923 | Kobbe | 2/20 |
| 1,479,771 | 1/1924 | Campbell | 2/159 |
| 2,710,409 | 6/1955 | Burandt | 2/160 |
| 2,738,190 | 3/1956 | Tureaud . | |
| 3,890,648 | 6/1975 | Beal . | |
| 3,896,498 | 7/1975 | Pang . | |
| 4,617,684 | 10/1986 | Green et al. . | |
| 4,987,611 | 1/1991 | Maye . | |
| 5,173,963 | 12/1992 | Greenberg . | |

*Primary Examiner*—Gloria M. Hale
*Attorney, Agent, or Firm*—Terrance L. Siemens

[57] ABSTRACT

A cushion for absorbing impacts from baseballs and the like. The cushion is worn beneath a glove, and comprises a base panel fabricated from leather and an absorbent panel fabricated from foam rubber. That portion formed by foam rubber overlies the upper palm of the user's hand. The leather panel extends over one finger just sufficiently far to support a band encircling that finger. The band immobilizes the cushion when worn. The band is an open loop closed by hook and loop material, thereby enabling adjustment of the circumference of the band when closed. The leather panel extends laterally to the side of the palm at which point a tether is attached. The tether retains the novel cushion together with a particular glove.

12 Claims, 2 Drawing Sheets

CUSHION FOR ATHLETIC GLOVE

BACKGROUND OF THE INVENTION

1. Field of the Invention

The present invention relates to a hand guard for protecting the palm of a person engaged in sports or other manual activities imposing discomfort upon the palm. More particularly, the invention comprises a pad worn on the palm, the pad having a member for encircling a digit of the hand and a tether for tethering the pad to an external article, such as a glove.

2. Description of the Prior Art

It is well known that protective gloves may fail to provide adequate protection to the hands of a person engaged in sports, gardening, and other activities requiring handling of objects. In particular, catching, grasping, and otherwise engaging rapidly moving objects may impose impacts on the hand. While gloves provide covering and a general measure of protection about much or all of the hand, this protection may fall short where rapid or frequent impacts occur. This situation is particularly encountered in baseball and even in softball. A person may be required to catch a ball which has been struck by a batter with great velocity. While softball and baseball gloves are padded, there is a propensity for persons fielding such hard hit balls to experience pain and injury to the upper palm area of the hand due to inadequate shock absorbency of gloves.

The prior art has proposed auxiliary guards or pads to be worn directly over the palm to mitigate this problem. U.S. Pat. No. 3,890,648, issued to Robert Eugene Beal on Jun. 24, 1975, describes a protector providing cushioning over the knuckle joints and related areas of the hand. Beal's device includes an extension for extending along the index finger, the extension providing a connecting member for attaching a band for engaging the index finger to the protector. Unlike the present invention, the band of Beal does not open and adjust to different circumferences. Also, the device of Beal lacks a tether for tethering the protector to a glove.

A protective band shown in U.S. Pat. No. 5,173,963, issued to Bert Greenberg on Dec. 29, 1992, encircles the index finger in the manner of Beal and the present invention, but lacks both ability to open to adjust the circumference and a tether, both being seen in the present invention.

A protective pad seen in U.S. Pat. No. 4,617,684, issued to Paul G. Green et al. on Oct. 21, 1986, has a band for encircling the index finger and a second band for encircling the palm. Green et al. lacks the ability to open the band encircling the index finger and the tether of the present invention.

None of the above inventions and patents, taken either singly or in combination, is seen to describe the instant invention as claimed.

SUMMARY OF THE INVENTION

The present invention provides a guard suitable for complementing protection afforded by a baseball or softball glove. The novel guard comprises a cushion worn under the glove on the palm of the hand. The novel cushion is dimensioned and configured to cover the knuckle joints of the palm, and to engage the index finger by encirclement. This engagement secures the cushion in its effective location on the palm. The band encircling the index finger opens, and the circumference may be adjusted within a range. This characteristic enables the cushion to be adjusted to hands and fingers of different dimensions, while maintaining comfort and not requiring construction from an elastic material. Hook and loop material provides a preferred fastener for closing the band. Hook and loop material establishes a satisfactory connection while accommodating minor misalignment of the mating members. Misalignment may prove desirable in cooperating with a person's hand.

In a further feature, a tether is provided for tethering the novel cushion to an associated glove. The tether assures that the cushion will remain with the glove, and not be lost, or require special efforts to prevent loss. The cushion may thus be kept together with a single associated glove. Ball players in particular establish affinities for personal articles, and the tether allows a player to remain confident that when a particular glove is in his or her possession, a well known, particular cushion is also at hand.

The cushioning material comprises a flexible stratum providing structural strength and a shock absorbent stratum. The former comprises leather or an equivalent, and extends to that section covering the index finger. While leather imparts a measure of impact resistance, it is not sufficient to protect a ball player fielding a hard hit ball. Therefore, a sponge rubber or equivalent lining is bonded to the leather, and is located over that portion of the palm most susceptible to injury. Sponge rubber is highly effective at mitigating impacts, but lacks sufficient strength to yield adequate service life when subjected to forces arising from the tether and even the band encircling the index finger. Leather is regarded as a far more suitable material for providing a flexible yet strong base for supporting the foam rubber lining. Therefore, the absorbent lining occupies a limited area of the structural base member.

Accordingly, it is a principal object of the invention to provide a cushion for protecting the upper palm of the hand from impacts.

It is another object of the invention to provide an adjustable band for encircling a finger of the hand, for assuring that the cushion remain in a constant position on the hand.

It is a further object of the invention to provide a tether for tethering the novel cushion to an associated glove.

Still another object of the invention is to provide a strong yet flexible base, together with a shock absorbent liner located over a limited area of the base.

An additional object of the invention is to fasten the band encircling the finger by hook and loop material.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
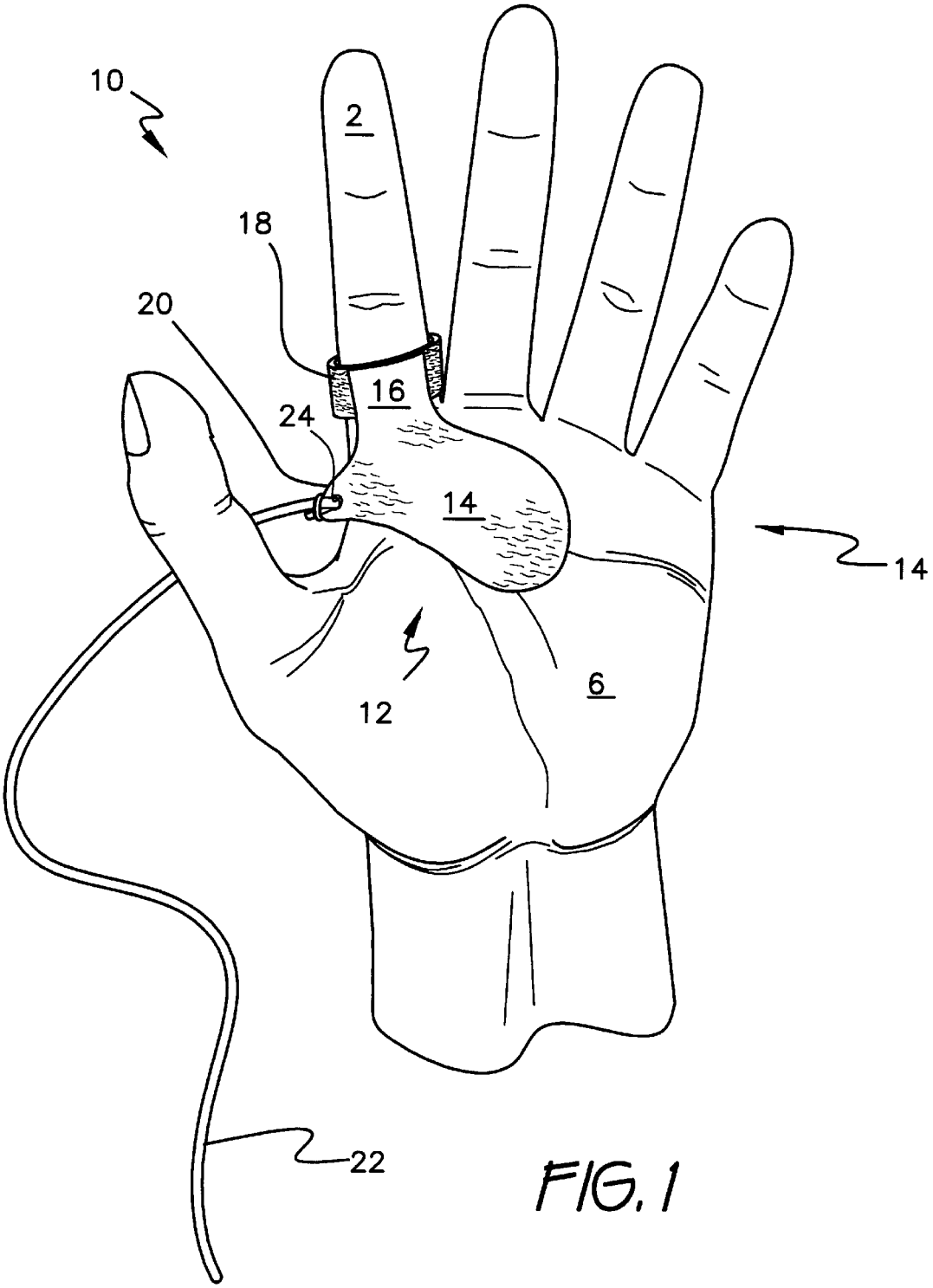
FIG. 1 is an environmental, front perspective view of the invention.

FIG. 1 shows the novel cushion 10 as it is worn by a person prior to donning an athletic glove (not shown). Cushion 10 is seen to comprise a base panel 12 fabricated from a flexible material such as leather. Base panel 12 has a first section 14 dimensioned and configured to cover a portion of the palm of a user's hand and a second, coplanar section 16 dimensioned and configured to project along one finger 2 of the hand 4.

A band 18 is disposed upon section 16 of base panel 12 and forms a loop for encircling finger 2. Band 18 is stitched or otherwise suitably joined to section 16.

Base panel 12 has a third section 20 projecting from first section 14. Section 20 projects to the left, as depicted in FIG. 1, thereby extending beyond the edge of the palm 6. A tether 22 is fastened at one end to base panel 12 for tethering cushion 10 to the athletic glove by inserting the end of tether 22 through an opening 24 formed in section 20 of base panel 12 and tying tether 22 around opening 24. Tether 22 may comprise a strip of leather, a fabric cord, or any other suitable flexible, strong material.

Projection of section 20 from section 14 of base panel 12 therefore locates the point of anchorage of tether 22 well apart from section 14 and thus from palm 6 of the hand 4. This location renders tether 22 unobtrusive when worn. This is important, since a minor distraction may well impair concentration of the user as he or she fields a ball (not shown).

Figure 2:
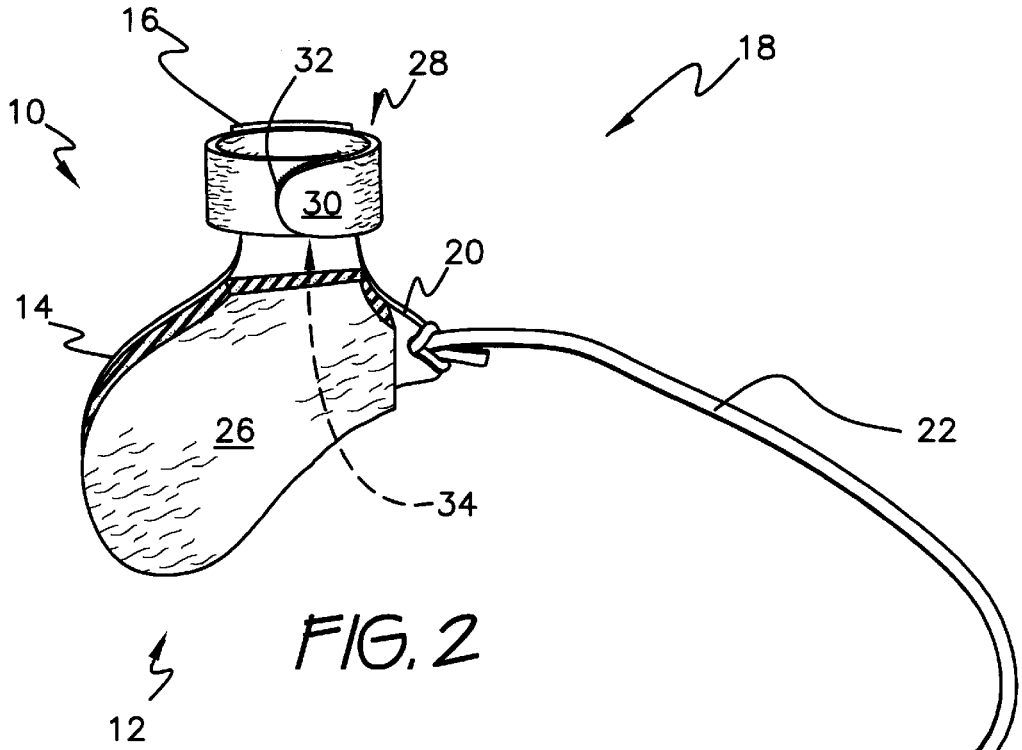
FIG. 2 is rear perspective view of the invention.

FIG. 2 shows the reverse side of cushion 10. A second panel 26 is fastened to base panel 12 in overlying and substantially abutting relationship. Panel 26 is fabricated from a shock absorbent material, and thus imparts the bulk of shock absorbing or diffusing characteristics to cushion 10. Panel 26 overlies only that portion of the palm 6 which is judged susceptible to injury or pain from catching hard hit balls. The edges of panel 26 may be coextensive with corresponding edges of panel 12, although this is not critical. However, it is preferred that the entire area of panel 26 be covered by panel 12 for extending the service life of panel 26.

FIG. 2 also shows an arrangement for closing band 18. Band 18 has overlapping ends 28, 30. One end 28 is lined with hook component 32 of hook and loop fastening material, and the other end 30 is lined with loop component 34. Hook and loop material is preferred as a fastener since it is adjustable in that no predetermined, invariable overlying alignment is required between ends 28, 30. This characteristic enables ready adjustment of the circumference of the closed loop formed by band 18 when ends 28, 30 are joined, as depicted in FIG. 2. Ends 28 and 30 may also be adjusted relative to linear alignment, if it is desired to adjust band 18 to a frustoconical configuration.

Figure 3:
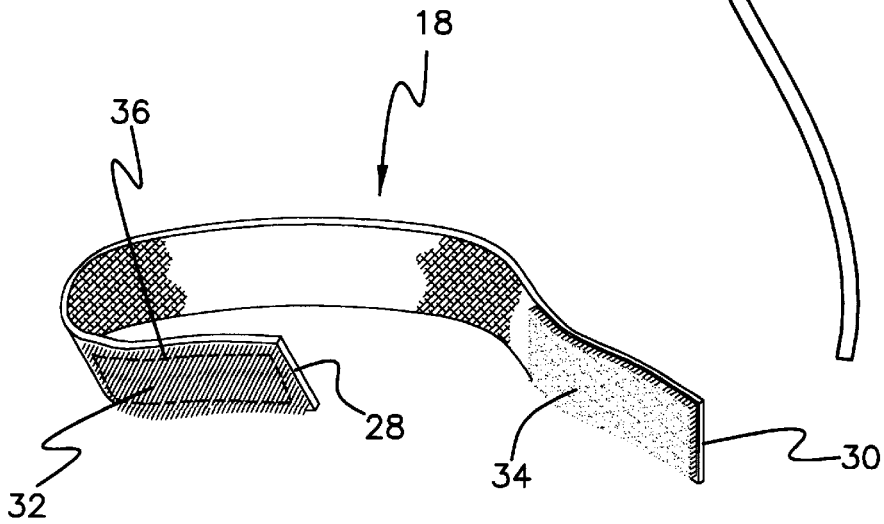
FIG. 3 is a rear perspective detail view of the invention, showing a finger engaging band opened for installing or adjustment.

FIG. 3 shows further detail of hook material 32 and loop material 34. Since hook and loop material is commercially available in patches, a suitable patch may be cut to a preferred dimensions and fastened permanently to band 18 by stitching 36 or in any other suitable way. Similarly, band 18 may be stitched to section 16 of base panel 12.

Leather is a preferred material for base panel 12 and for band 18 since it is readily available and has adequate strength and flexibility for the application. Leather is permeable to water and air, thereby remaining reasonably comfortable when worn under playing conditions. Leather accepts stitching without significantly impairing the other qualities.

Panel 26 is preferably fabricated from an expanded foam form of a synthetic resin. Such materials are readily available and exhibit suitable shock absorbency and resilience. A suitable expanded foam may be selected to accept an adhesive (not shown) for bonding panel 26 to panel 12.

While the inventive concept has been set forth in a particular manner deemed most suitable, it is nonetheless susceptible to variations and modifications which may be introduced by those of skill in the art. For example, the constituent materials may be replaced by substitutes having similar properties. Bonding of the various components may be by other means. Tether 22 may fasten to panel 12 other than by tying. Optionally, tether 22 may merely pass through opening 24 and be tied or otherwise fastened to the associated glove.

In further examples, section 16 of panel 12 may engage a finger other than index finger 2. Hook and loop material 32 and 34 may be replaced by other types of fasteners. Panels 12 and 26 may be extended as desired to provide protection to any desired area of the palm 6.

It is to be understood that the present invention is not limited to the embodiments described above, but encompasses any and all embodiments within the scope of the following claims.

I claim:

1. A cushion for an athletic glove, comprising:

a base panel fabricated from a flexible material, said base panel having a first section dimensioned and configured to cover a portion of the palm of a user's hand and a second coplanar section dimensioned and configured to project along one finger of the hand;

a second panel abutting and fastened to said base panel, said second panel fabricated from a shock absorbent material;

a band disposed upon said second section of said base panel, forming a loop for encircling the finger; and a tether for tethering said cushion to the athletic glove, said cushion having means for fastenably engaging said tether.

2. The cushion according to claim 1, said band having an adjustable fastener for adjusting its circumference.

3. The cushion according to claim 2, said adjustable fastener comprising hook and loop material.

4. The cushion according to claim 1, said base panel having a third section, said third section projecting from said first section, for locating the point of anchorage of said tether apart from said first section and thus from the palm of the hand.

5. The cushion according to claim 1, said base panel fabricated from leather and said second panel fabricated from an expanded foam form of a synthetic resin.

6. A cushion for an athletic glove, comprising:

a base panel fabricated from a flexible material, said base panel having a first section dimensioned and configured to cover a portion of the palm of a user's hand, a second coplanar section dimensioned and configured to project along one finger of the hand, and a third section, said third section projecting from said first section, for locating the point of anchorage of said tether apart from said first section and thus from the palm of the hand;

a second panel abutting and fastened to said base panel, said second panel fabricated from a shock absorbent material;

a band disposed upon said second section of said base panel, forming a loop for encircling the finger, said band having an adjustable fastener comprising hook and loop material, for adjusting its circumference; and a tether fastened at one end to said cushion, for tethering said cushion to the athletic glove.

7. The cushion according to claim 6, said base panel fabricated from leather and said second panel fabricated from an expanded foam form of a synthetic resin.

8. A cushion for an athletic glove, comprising:

a base panel fabricated from a flexible material, said base panel having a first section dimensioned and configured to cover a portion of the palm of a user's hand and a second coplanar section dimensioned and configured to project along one finger of the hand;

a second panel abutting and fastened to said base panel, said second panel fabricated from a shock absorbent material;

a band disposed upon said second section of said base panel, forming a loop for encircling the finger, said band having an adjustable fastener for adjusting its circumference.

9. The cushion according to claim 8, further comprising a tether fastened at one end to said cushion, for tethering said cushion to the athletic glove.

10. The cushion according to claim 8, said adjustable fastener comprising hook and loop material.

11. The cushion according to claim 8, said base panel having a third section, said third section projecting from said first section, for locating the point of anchorage of said tether apart from said first section and thus from the palm of the hand.

12. The cushion according to claim 8, said base panel fabricated from leather and said second panel fabricated from an expanded foam form of a synthetic resin.

* * * * *